United States Patent [19]

Seilly et al.

[11] 4,091,784

[45] May 30, 1978

[54] FUEL INJECTION SYSTEMS FOR INTERNAL COMBUSTION ENGINES

[75] Inventors: Alec Harry Seilly; Paul Lakra, both of Wembley, England

[73] Assignee: Lucas Industries Limited, Birmingham, England

[21] Appl. No.: 721,601

[22] Filed: Sept. 8, 1976

[30] Foreign Application Priority Data

Sept. 19, 1975 United Kingdom ..... 38493/75

[51] Int. Cl.[2] ..... F02D 5/02

[52] U.S. Cl. ..... 123/139 AT; 123/139 AS

[58] Field of Search ..... 251/129; 123/139 E, 123/139 AT, 139 AK, 139 AS, 139 DP

[56] References Cited

U.S. PATENT DOCUMENTS

| | | | |
|---|---|---|---|
| 2,984,231 | 5/1961 | Cummins | 123/139 AT |
| 3,837,324 | 9/1974 | Links | 123/139 E |
| 3,919,989 | 11/1975 | Jarrett et al. | 123/139 R |
| 3,961,612 | 6/1976 | Okamoto et al. | 123/139 E |
| 3,983,855 | 10/1976 | Jarrett | 123/139 E |

*Primary Examiner*—Charles J. Myhre
*Assistant Examiner*—Tony M. Argenbright
*Attorney, Agent, or Firm*—Ladas, Parry, Von Gehr, Goldsmith & Deschamps

[57] ABSTRACT

A fuel injection system for supplying fuel to a combustion space of an internal combustion engine includes a nozzle having a valve member urged to the closed position by fluid under pressure derived from an accumulator. A displacement piston is movable to supply fuel under pressure to the nozzle upon opening of a solenoid operable valve and return motion of the piston is effected by closing the valve and opening a further solenoid operated valve. The return motion of the piston is achieved by fuel under pressure supplied to one end of the cylinder containing the piston.

5 Claims, 9 Drawing Figures

FUEL INJECTION SYSTEMS FOR INTERNAL COMBUSTION ENGINES

This invention relates to fuel injection systems for supplying fuel to internal combustion engines.

The object of the invention is to provide such a system in a simple and convenient form.

According to the invention, a fuel injection system for supplying fuel to an internal combustion engine comprises in combination, a stepped valve member movable within a cylinder, the narrower end of said valve member constituting a valve to control flow through an outlet, a conduit through which the wider end of said valve member is subject to a fluid pressure so that the valve is urged to a closed position, a further conduit through which fuel under pressure can flow to act on a step on said valve member to move the valve member to an open position and to allow fuel flow through said outlet, a displacement piston movable within a cylinder, one end of said cylinder communicating with said further conduit, a valve controlled fuel inlet to said one end of the cylinder, an operating piston slidable within a further cylinder, said operating piston having a larger area than said displacement piston, a supply conduit leading to the end of said further cylinder remote from said displacement piston, a first solenoid operated valve for connecting said supply conduit to said first-mentioned conduit whereby when said first solenoid operated valve is open the displacement piston will be moved to generate a fuel pressure to act on said valve member, a second solenoid operated valve operable when said first solenoid operated valve is closed, to connect said supply conduit with a drain thereby to permit the displacement and operating pistons to move under the action of fuel flowing to said one end of the cylinder, means for sensing the extent of movement of said pistons and a control circuit to which a signal from said means is supplied for controlling the operation of said first and second solenoid operated valves.

One example of a fuel injection system in accordance with the invention will now be described with reference to the accompanying drawings in which.

Figure 2:
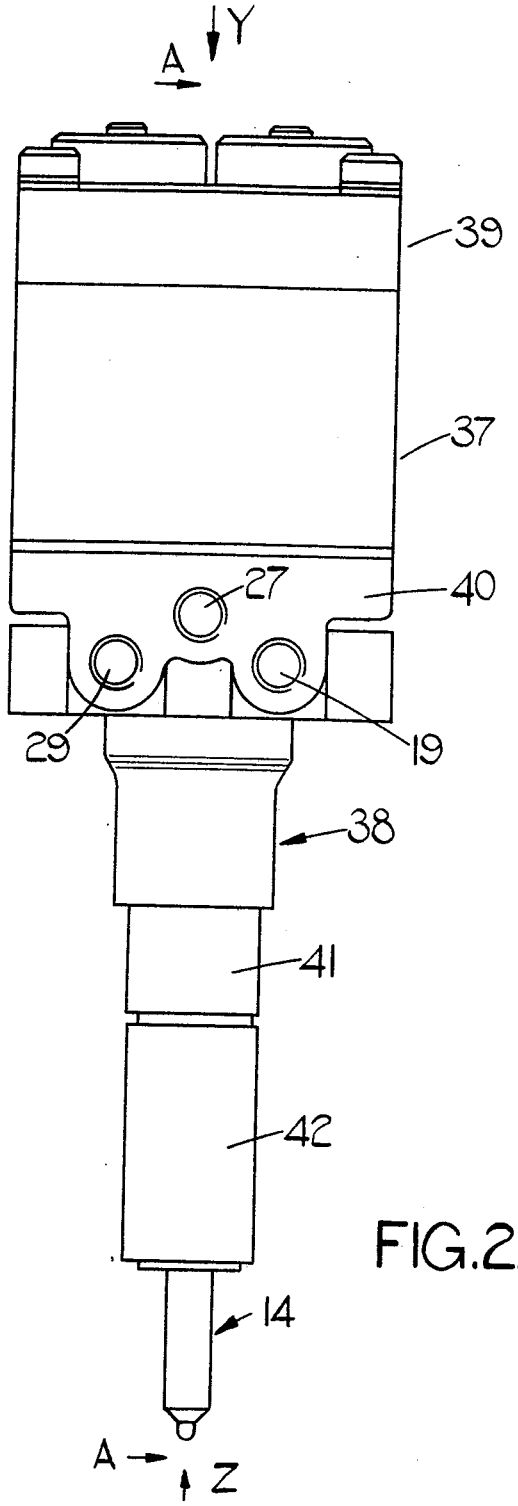
FIG. 2 shows an external view of a practical embodiment of the system.
Figure 3:
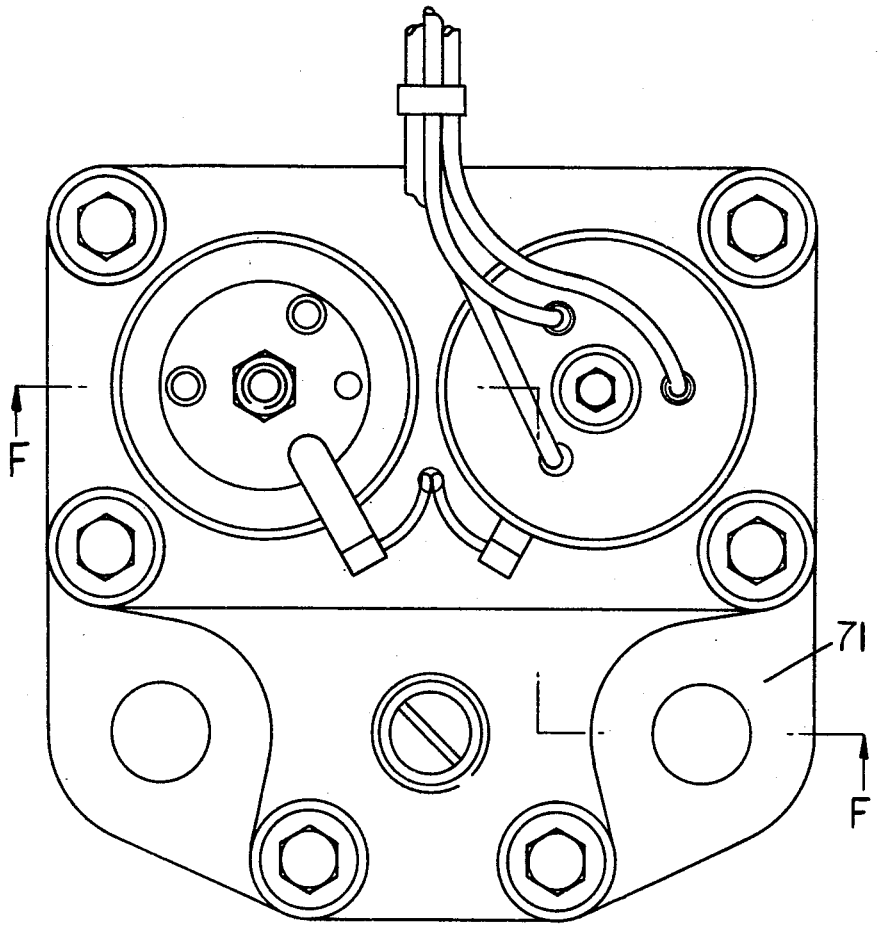
FIG. 3 is a view in the direction of the arrow Y of FIG. 2.
Figure 4:
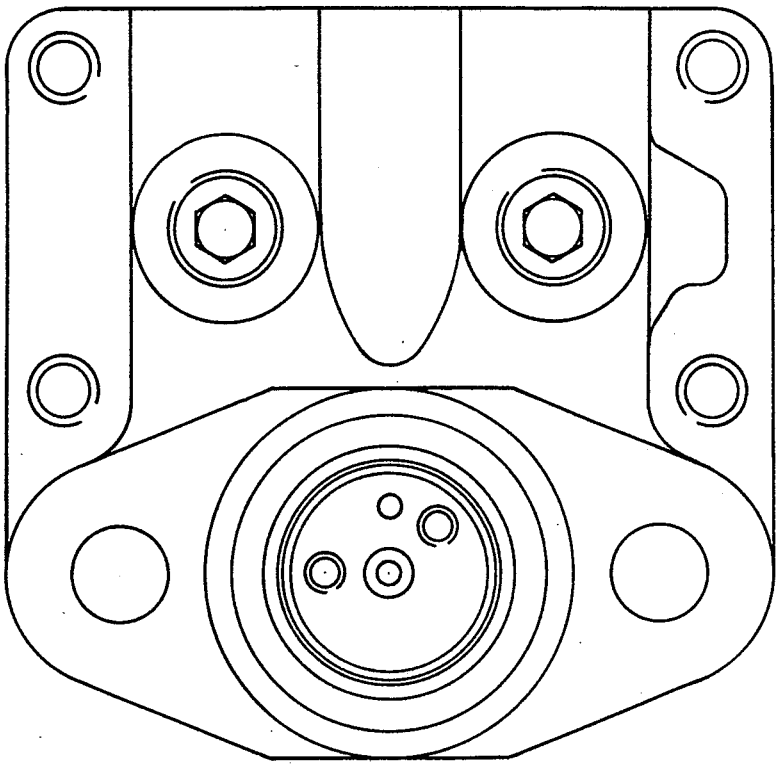
Figure 5:
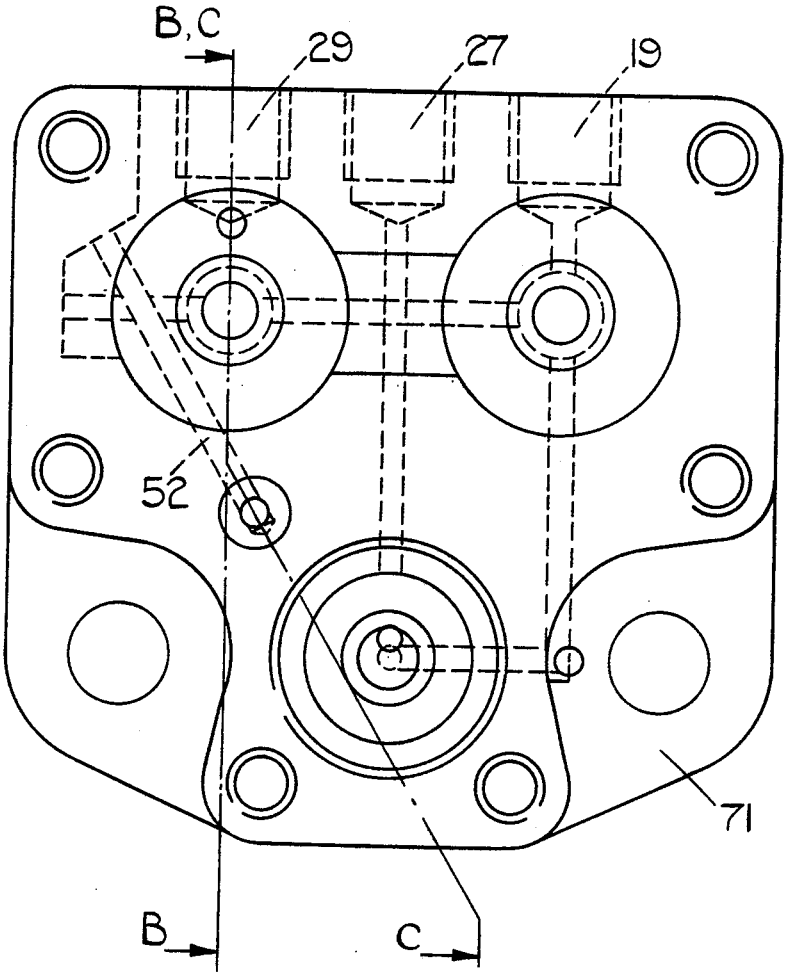
Figure 6:
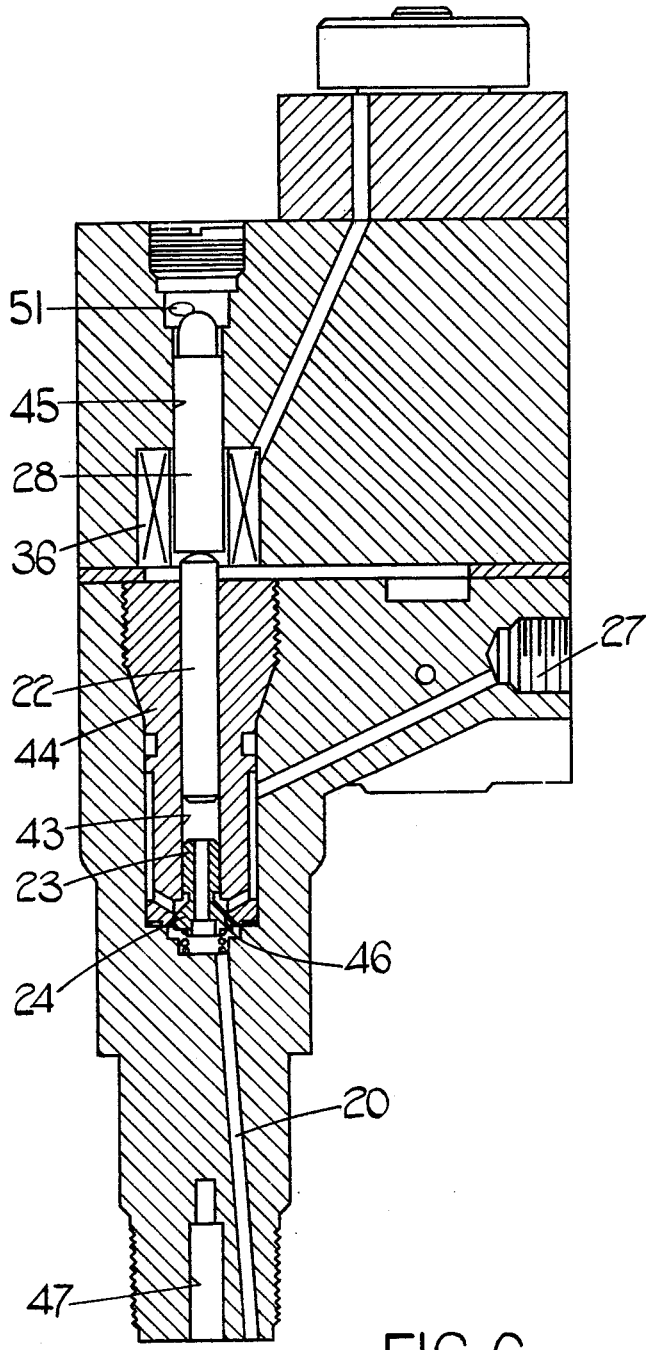
Figure 7:
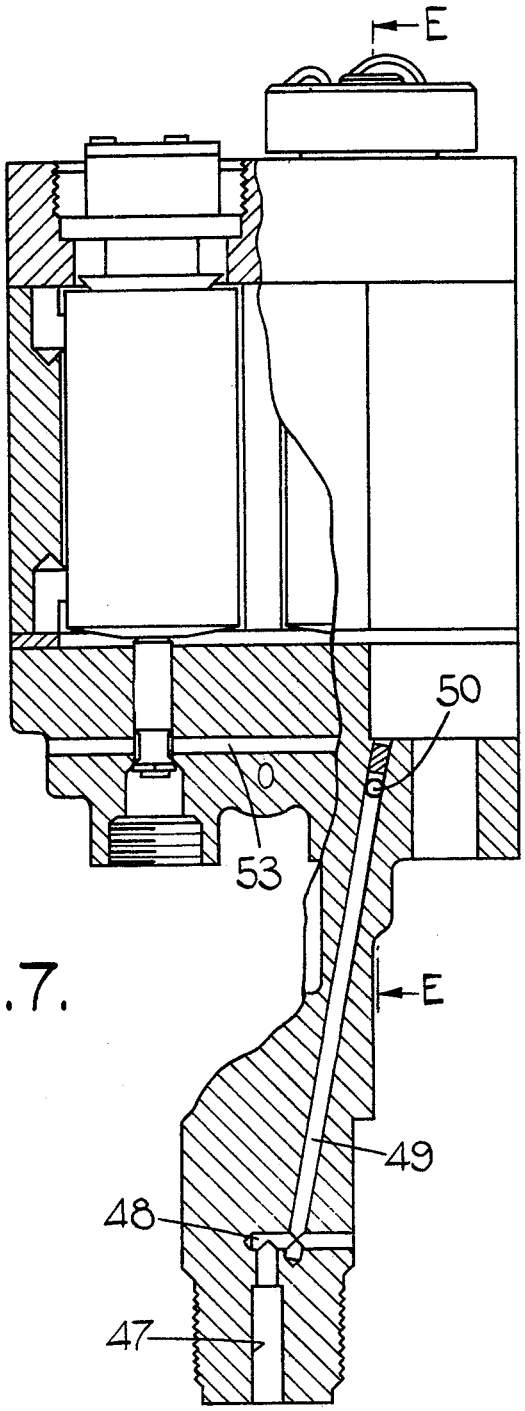
Figure 8:
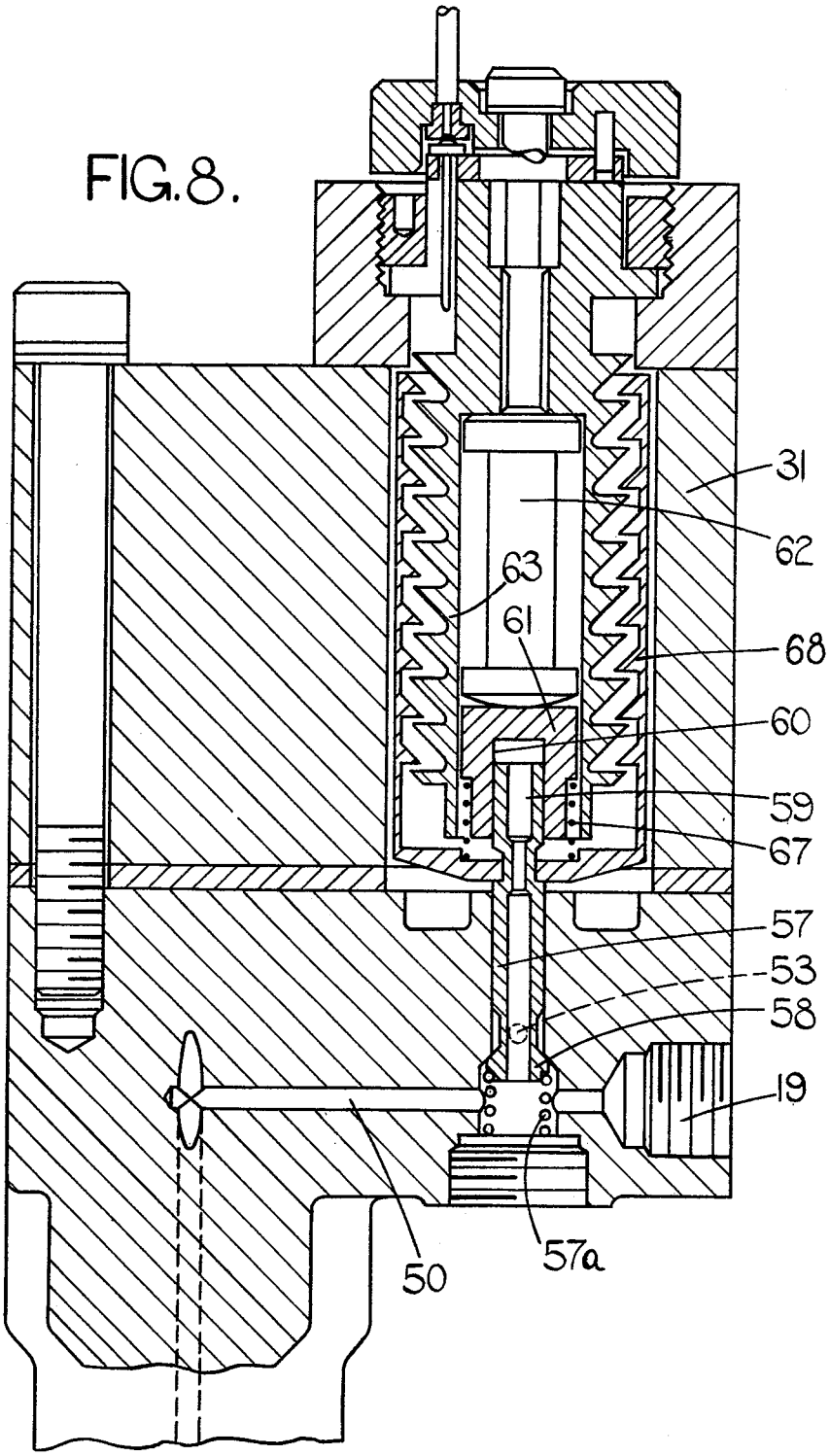
Figure 9:
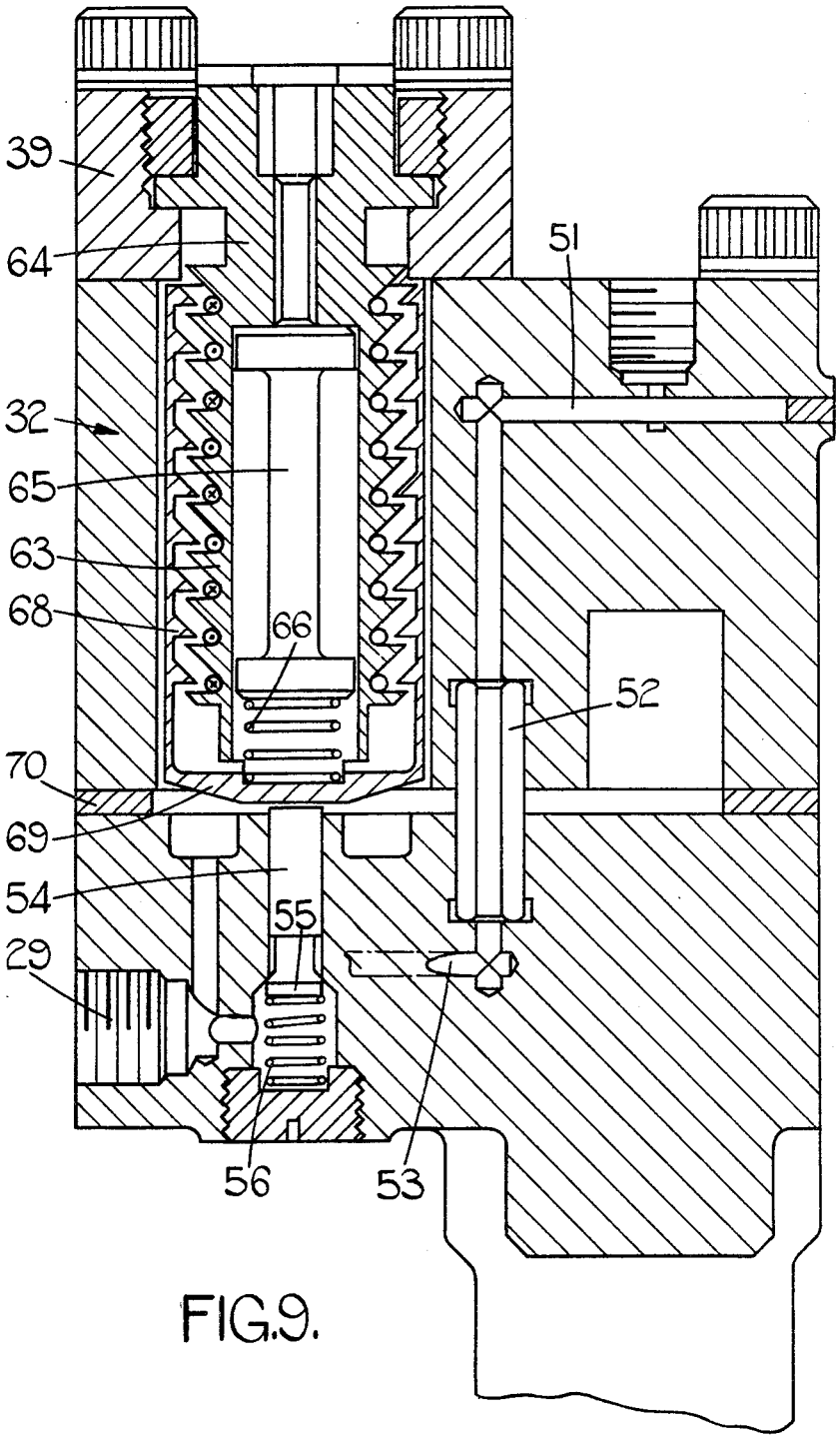

FIG. 4 is a view in the direction of the arrow Z of FIG. 2 with parts removed for the sake of clarity, FIG. 5 is a view in the direction of the arrow Y of FIG. 2 again with parts removed for the sake of clarity, FIG. 6 is a section on the line A—A of FIG. 2, FIg. 7 is a section on the line F—F of FIG. 3, FIG. 8 is a section on the line E—E of FIG. 7, and FIG. 9 is a composite section on the lines B—B, C—C of FIG. 5.

Figure 1:
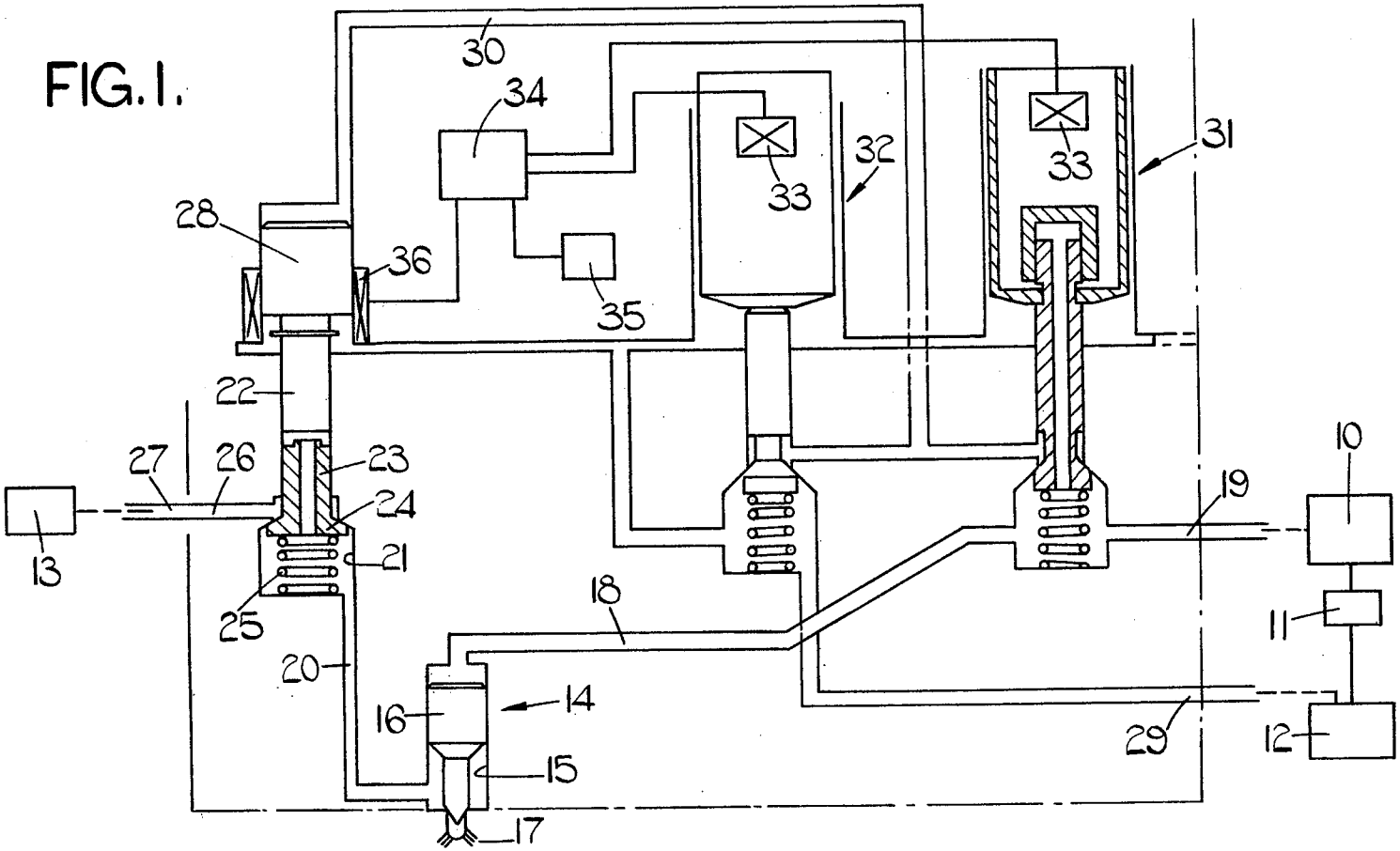
FIG. 1 is a diagrammatic illustration of the system.

With reference to FIG. 1 of the drawings, the fuel system illustrated therein is for supplying fuel to one cylinder of a compression ignition engine, it being appreciated that for a practical engine there are as many systems of the type shown in FIG. 1 as there are engine cylinders. The common portion of the overall fuel system includes an accumulator 10 in which liquid fuel is stored at the high pressure, the fuel being supplied to the accumulator by means of a pump 11 from a source of fuel 12. Conveniently the pressure in the accumulator will be of the order of 300 atmospheres. Also provided and forming part of the common system is a low pressure fuel pump 13 capable of supplying fuel at a pressure in the order of 15 atmospheres.

The individual fuel system includes a nozzle head diagrammatically illustrated at 14 and including a cylinder 15 in which is slidable a stepped valve member 16 the narrower end of the valve member is shaped for co-operation with a seating defined at one end of the cylinder thereby to control the flow of fuel through orifices 17 to a respective cylinder or combustion space of the engine with which the system is associated. Also provided is a first conduit 18 which communicates with an inlet 19 the latter being in constant communication with the accumulator. The conduit 18 communicates with the cylinder 15 at the end thereof remote from the seating so that the pressure of fuel within the accumulator is applied to the wider end of the valve member 16 thereby urging the valve member into contact with the seating. The other end of the cylinder communicates with a further conduit 20 which communicates with one end of a cylindrical chamber 21. The chamber 21 is of stepped form having a narrower portion intermediate its ends and in which is accommodated a slidable displacement piston 22. Also accommodated within the narrower portion of the chamber is the body of a valve element 23 having a head portion 24 which can be urged into contact with a seating defined in the wall of the chamber 21 by means of a coiled compression spring 25. The head of the valve element 23 is subjected to the pressure of fuel delivered by the pump 13 by way of a passage 26 communicating with a further inlet 27. The wider end of the chamber accommodates an operating piston 28 which contacts the displacement piston 22 and which has a larger area than the displacement piston 22. Conveniently, the area of the end surface of the operating piston is about twice that of the displacement piston. Moreover, the annular space surrounding the displacement piston and the wider end of the chamber 21 communicates with a drain outlet 29 which in use, is connected with a pipeline whereby any fuel flowing out of the outlet is returned to the supply tank 12.

The opposite end of the enlarged portion of the chamber 21 is connected to a supply conduit 30 and the supply conduit 30 can be placed in communication with the inlet 19 or with the outlet 29 by means of first and second solenoid operable valves 31, 32 respectively.

The construction of the valves 31 and 32 will be described in greater detail later. However, each valve includes a winding 33 which when energised, causes opening of the associated valve and the supply of electric current to the windings 33 is controlled by a control circuit 34 which in addition receives a demand signal from a transducer 35 and also a signal from a winding 36 associated with the displacement and operating pistons 22, 28.

In the position shown, both valves are closed and the displacement piston 22 is spaced from the valve element 23. When the valve 31 is opened the supply conduit 30 is placed in communication with the inlet 19 and therefore fuel at accumulator pressure, acts upon the operating piston 28. This together with the displacement piston, moves downwardly as shown in the drawing and fuel is displaced to the conduit 20 by way of a passage extending between the ends of the valve element 23. Because of the differential areas of the operating piston and the displacement piston, the pressure of fuel in the conduit 20 is substantially higher than the accumulator pressure with the result that the valve member 16 is lifted from its seating so that flow of fuel can take place to the engine through the orifices 17. This flow of fuel continues until the displacement piston 22 contacts the valve element 23 thereby lifting the valve element from its seating and lowering the pressure in the conduit 20 to that existing at the inlet 27. As a result of the lowering of pressure in the conduit 20 the valve member 16 is urged onto its seating and flow of fuel to the engine ceases. The extent of movement of the displacement piston 22 is limited by a collar about its periphery.

The valve 31 is then closed and the valve 32 opened with the result that the supply conduit 30 is placed in communication with the drain outlet 29. When this communication is established the valve element 23 is held in the open position by the fuel pressure in the passage 26 and fuel at the low pressure existing in this passage flows into the chamber 21 and displaces the displacement piston 22 and the operating piston 28 in the upward direction as seen in FIG. 1. A signal indicating the extent of movement is provided by the winding 36 and this is passed to the control circuit 34. The control circuit 34 compares the signal produced by the winding 36 with the signal produced by the transducer 35 and when the appropriate amount of fuel has flowed into the chamber 21 the valve 32 is closed. Closure of the valve 32 creates an hydraulic lock in the passage 30 and movement of the pistons 22 and 28 is halted. The valve element 23 then closes onto its seating under the action of the spring 25 and the components of the system assume the positions shown in FIG. 1, with the pressure in the cylinder 15 being substantially equal to the pressure of fuel delivered by the source 13. The system is then ready to deliver a further quantity of fuel when the valve 31 is opened. For this purpose the control circuit 34 must also receive a signal indicative of the position of the engine so that delivery of fuel to the engine can take place at the correct instant.

Reference will now be made to the remaining drawings illustrating the practical embodiment. As shown in FIG. 2 there is provided a multi-part body comprising three parts 37, 38 and 39. The various parts are secured together by means of studs which are shown in the various drawings. The part 38 includes a head portion 40 from which extends a generally tubular portion 41 to which is secured the nozzle head 14 by means of a conventional form of retaining cap 42. The head portion 40 defines the inlets 19 and 27 and the drain outlet 29. The portion 37 of the body accommodates the main portions of the solenoid operable valves and the portion 39 is a location cap which also serves to accommodate the electrical connections to the solenoid valves.

Referring to FIG. 6, there is illustrated the conduit 20 communicating with the chamber 21 which in this particular example, is in part defined by a bore 43 formed in an insert 44 in screw-thread engagement with the body and in part by an enlarged bore 45 formed in the body portion 37. The displacement piston is indicated at 22 and the operating piston at 28. The end of the insert 44 is shaped to define a seating 46 against which can seat the shaped head 24 of the valve element 23. As will be seen the insert is also provided with outwardly extending passages which communicate with the fuel inlet 27. Also indicated in FIG. 6 is the sensing coil 36 and in this particular example the extent of the movement of the displacement piston is determined not by a collar on the displacement piston but by the abutment of the operating piston 28 with the end face of the insert 44.

In FIG. 6 the body portion 41 is illustrated as having a centrally disposed blind bore at its end to which the injection nozzle is secured. This bore which is referenced 47 together with a cross drilling 48 (FIG. 7), a further drilling 49 and a cross drilling 50 shown in FIG. 8, communicating with the inlet 9, constitutes the conduit 18 of FIG. 1.

The end of the bore 45 remote from the displcement piston 22 communicates with a drilling 51 formed in the body portion 37 and which by way of a connector piece 52 seen in FIG. 9 communicates with a further drilling 53 extending between the solenoid operable valves 31, 32. These drillings together with the connector piece 52 constitute the conduit 30.

The valves 31 and 32 are of substantially identical construction but since the valve 31 is dealing with fuel at a high pressure, a special construction is necessary to ensure that the force required to be exerted to effect operation of the valve is not unduly high. The valve 32 is only required to operate when the fuel pressure to which it is subjected, is low and therefore no appreciable pressure balancing is required although it should be noted that it is subjected to the pressure within the accumulator 10 when the valve 31 is opened.

Considering the valve 32 (FIG. 9) it comprises a slidable valve element 54 which is located within the portion 40 of the body. The valve element 54 is provided with a head 55 shaped to co-operate with a seating and it is urged into contact with this seating by means of a coiled compression spring 56. The chamber containing the coiled compression spring is in communication with the outlet 29. Moreover, below the head 55 the member 54 defines an annular groove which is in communication with the drilling 53 forming part of the conduit 30. As shown in FIG. 9 the valve element is in the closed position and it therefore corresponds to the position of the valve element shown in FIG. 1.

The valve 31 (FIG. 8) includes a valve element 57 similar to that of the valve 32. The valve element 57 is provided with a head 58 and also an annular groove which communicates with the drilling 53. A return spring **57*a* is provided to act on the valve element 57. The valve element 57 has an extended portion 59 which constitutes a piston and a drilling extends between the ends of the valve element and its extended portion. The piston 59 is slidable within a blind cylindrical bore 60 which is formed in a member 61 which is retained against axial movement by means of a location element 62. As will be seen from FIG. 8, the end surface of the head 58 of the valve element 57 is subjected to the accumulator pressure by reason of the chamber in which it is located being in communication with the inlet 19. By virtue of the provision of the piston portion 59 and the cylinder 60 and also the communication between the ends of the valve element, the valve element is substantially pressure balanced so that the force required to move it will be comparable to the force required to move the valve element 54 of the valve 32**.

The solenoids and the associated armatures of the valves 31 and 32 are of identical construction. In the particular arrangement the solenoid includes a core 63 which is of annular form but which at one end is connected to a support portion 64 which is located against axial movement within the cap portion 39 of the body. As is shown in FIG. 8, the member 61 which defines the cylinder 60 and the location element 62 are positioned within the core 63 and in the case of the valve 32 a further location element 65 is located within the core, the element 65 serving as an abutment for a coiled compression spring 66 which serves to urge the armature 68 associated with the solenoid into contact with the valve member 54. In the case of the valve 31 the spring 67 which serves the same purpose as the spring 66 is positioned between the armature and a shoulder defined upon the outer periphery of the member 61.

As previously mentioned, the armature 68 is of annular form and having a base wall 69 which in the case of the valve 32 presses directly upon the valve element 54. In the case of the valve 31 the base wall is provided with an aperture through which a reduced portion of the valve element 57 extends, the base wall however pressing against a shoulder defined on the element 57.

The presented faces of the core and the armature are provided with ribs and in the particular example these ribs are of helical form. In the particular example the ribs are constituted by a two-start helical thread form so that on both the core and the armature two helical ribs are defined. The side walls of the ribs have a special shape and the armature and the core are slightly displaced relative to each other in the axial direction. Moreover, the adjacent faces of the ribs on the core and those on the annulus which are closer to each other are in sectional view, substantially parallel and radially disposed whilst the other faces whilst being substantially parallel to each other are spaced by a greater extent and are also inclined. As shown in FIG. 9 the troughs defined by the two ribs on the core accommodate windings. In the particular example a single turn continues winding is employed and this starts at the cap end of the core and extends along one trough to the other end of the core and is then returned along the other trough to the cap end of the core. The connections to the windings pass to terminal assemblies and can be connected in use to the control circuit 34.

When the winding is supplied with electric current the direction of current flow in the portions of the winding lying in the two troughs is in the opposite direction and as a result the two ribs throughout their length will be polarised to opposite magnetic polarity. Moreover, considering a portion of one of the ribs the magnetic flux generated by the portions of the winding on the opposite sides of this portion of the rib will reinforce each other.

When the winding is energised therefore the armature 68 will move in a direction to reduce the reluctance and as seen in the drawings, the armature will move downwards thereby effecting operation of the associated valve element.

It will be appreciated that although a single turn winding is illustrated in the practical arrangement, several turns of wire may be provided in the troughs. When the winding is de-energised the armature of the valve 32 is returned by means of the spring 56 against the action of the spring 66 and the armature of the valve 31 is returned by the spring 57*a*.

The chambers defined in the body portion 37 and which accommodate the solenoids and the armatures, communicate with the drain outlet 29 and generally this is achieved by providing a space between the opposed faces of the heat portion 40 and the body portion 37, this space being determined by a gasket 70. As will be seen from FIGS. 3, 4 and 5 the head portion 30 defines apertured flange portions 71 whereby the body portion can be secured to the cylinder head of the internal combustion engine.

We claim:

1. A fuel injection system for supplying fuel to an internal combustion engine, comprising a body member adapted to be secured to the engine and including a reduced end portion and an enlarged portion having a first part which is integral with the reduced end portion and a second part which is secured by bolts to said first part, said body member defining:

a first cylinder formed in said reduced end portion and having a seating and an outlet orifice at one end;

a first inlet opening for connection to a source of fluid under pressure;

a second inlet opening for connection to a source of fuel under pressure;

a drain opening;

a first conduit which establishes communication between said first inlet opening and that end of said first cylinder which is opposite said one end;

a second cylinder;

a further conduit which establishes communication between one end of said second cylinder and said one end of the first cylinder;

a fuel inlet conduit for establishing communication between said second inlet and said one end of the second cylinder;

a third cylinder disposed coaxially relative to the second cylinder and being of larger cross-sectional area than said second cylinder;

first and second valve chambers formed in said first part and connected with the first conduit and the drain opening respectively; and a supply conduit for establishing communication between that end of said third cylinder which is remote from said second cylinder and both said first and second valve chambers, and the system further comprising:

a stepped valve member slidable within said first cylinder and having a narrow end portion and a wide end portion, said narrow end portion cooperating with said seating to control flow of fuel through said outlet orifice to a combustion space of the engine, said wide end portion presenting a first working surface at that end of the wide end portion which is remote from said narrow end portion and a second working surface which surrounds the narrow end portion at that end thereof which is nearer said wide end portion, said first working surface being subject to fluid pressure communicated from said first inlet opening to said first cylinder by way of said first conduit to urge the valve member to a closed position in which the valve member contacts the seating and the second working surface being subject to pressure of fuel communicated to said one end of the first cylinder from said second cylinder by way of said further conduit to urge the valve member to an open position to allow fuel through said outlet orifice;

a displacement piston movable within said second cylinder;

a valve for controlling the flow of fuel through said fuel inlet conduit to said one end of the second cylinder;

a first solenoid operable valve located within said enlarged portion of the body member and including a valve element accommodated in said first valve chamber and movable against the action of a spring to control flow of fluid from the first conduit to said supply conduit;

a second solenoid operable valve located within said enlarged portion of the body member and disposed in spaced, substantially parallel relationship with respect to said first solenoid operable valve and including a valve element accommodated in said second valve chamber and movable against the action of a spring to control flow of fluid from the supply conduit to the drain opening;

an operating piston located in said third cylinder, the operating piston having a larger area than the displacement piston so that when the first solenoid operable valve is open and the second solenoid operable valve is closed, fluid pressure is applied to the operating piston by way of the first inlet opening, the first conduit, the first valve chamber and the supply conduit and the displacement piston is moved by the operating piston to generate a fuel pressure to act on the second working surface of the stepped valve member, whereas when the first solenoid operable valve is closed and the second solenoid operable valve is open, the displacement piston and the operating piston are permitted to move in the second and third cylinders respectively under the action of fuel flowing into said second cylinder through said fuel inlet conduit;

sensing means mounted within the body part for sensing the extent of movement of the operating piston; and a control circuit to which a signal from said sensing means is supplied for controlling operation of said first and second solenoid operable valves, each of first and second solenoid operable valves including an annular armature accommodated in said second part of said enlarged portion and engaging the valve element, and a solenoid accommodated in said second part of said enlarged portion and comprising an annular core positioned within the armature, the cores of the first and second solenoid operable valves being connected to respective support portions which are secured to said second part of said enlarged portion, the side walls of the armatures and cores that are respectively presented to each other being formed each with a thread formation to define respective helical ribs on the armatures and the cores, and said cores carrying windings whereby when either of said solenoid operable valves is actuated by supplying electric current to its winding, relative axial movement takes place between the rib on the core of the valve and the rib on the armature of the valve, thereby to actuate the valve element of the valve.

2. A system as claimed in claim 1, wherein each armature is of cupshaped form having a base wall, the base walls of the armatures engaging the respective valve elements.

3. A system as claimed in claim 2, in which the base wall of the armature of the first solenoid operable valve is formed with an aperture, a member formed with a blind bore is located within the core of the first solenoid operable valve, and the valve element of the first solenoid operable valve has a portion extending through said aperture in the base wall into said blind bore, the valve element having a bore extending therethrough whereby both ends of the valve element are subjected to the same fluid pressure.

4. A system as claimed in claim 1, wherein the side walls of the armatures and cores that are respectively presented to each other are formed each with a two-start thread formation to define respective pairs of helical ribs on the armatures and cores.

5. A system as claimed in claim 4, wherein the two helical ribs of each pair of ribs on the cores define two helical grooves, and the winding carried by each core comprises two conductive portions laid in the grooves respectively, the two conductive portions being connected together in series at one end of the core so that, when direct current is passed through the winding, current passes along the two conductive portions about the core in opposite respective senses.

* * * * *